US011459173B2

(12) United States Patent
Han

(10) Patent No.: US 11,459,173 B2
(45) Date of Patent: Oct. 4, 2022

(54) FOOT ACTIVATED WASTE BIN

(71) Applicant: BARENTHAL NORTH AMERICA, INC., Whippany, NJ (US)

(72) Inventor: Hongyuan Han, New Vernon, NJ (US)

( * ) Notice: Subject to any disclaimer, the term of this patent is extended or adjusted under 35 U.S.C. 154(b) by 307 days.

(21) Appl. No.: 16/562,703

(22) Filed: Sep. 6, 2019

(65) Prior Publication Data

US 2020/0079587 A1 Mar. 12, 2020

Related U.S. Application Data

(60) Provisional application No. 62/727,836, filed on Sep. 6, 2018.

(51) Int. Cl.
*B65F 1/16* (2006.01)

(52) U.S. Cl.
CPC ..... *B65F 1/1638* (2013.01); *B65F 2210/168* (2013.01)

(58) Field of Classification Search
CPC ..... B65F 1/1638; B65F 2210/168
USPC ..... 220/211, 262, 263
See application file for complete search history.

(56) References Cited

U.S. PATENT DOCUMENTS

| | | | | |
|---|---|---|---|---|
| 7,530,578 | B2 * | 5/2009 | Niemeyer | B65F 1/1473 220/262 |
| 2006/0255033 | A1 * | 11/2006 | Yang | B65F 1/1638 220/211 |
| 2007/0182551 | A1 * | 8/2007 | Yang | B65F 1/08 340/545.3 |
| 2010/0308045 | A1 * | 12/2010 | Tong | B65F 1/08 220/211 |
| 2012/0000911 | A1 * | 1/2012 | Wang | B65F 1/1638 220/495.11 |
| 2013/0213965 | A1 * | 8/2013 | Shek | B65F 1/1638 220/211 |
| 2015/0259140 | A1 * | 9/2015 | Yang | B65F 1/1646 220/211 |
| 2019/0077595 | A1 * | 3/2019 | Wang | B65F 1/16 |
| 2021/0269238 | A1 * | 9/2021 | Shek | B65F 1/1623 |

* cited by examiner

*Primary Examiner* — J. Gregory Pickett
*Assistant Examiner* — Niki M Eloshway
(74) *Attorney, Agent, or Firm* — Preti Flaherty Beliveau & Pachios LLP

(57) ABSTRACT

Self-opening bins are described. The bin includes a base unit defining a foot well and a sensor configured to detect whether an object is within the foot well. The bin also has a receptacle and a lid configured to close the receptacle. A lid motor configured to mechanically open the lid is also included in the bin. The lid motor is configured to open the lid in response to detection of an object within the foot well. Methods for operating the self-opening bins are also described.

13 Claims, 11 Drawing Sheets

FOOT ACTIVATED WASTE BIN

STATEMENT REGARDING FEDERALLY SPONSORED RESEARCH OR DEVELOPMENT n/a

BACKGROUND OF THE INVENTION

Various embodiments relate generally to storage devices and apparatus and, more specifically, relate to foot-activated infrared (IR) sensor lid opening waste bins.

This section is intended to provide a background or context. The description may include concepts that may be pursued, but have not necessarily been previously conceived or pursued. Unless indicated otherwise, what is described in this section is not deemed prior art to the description and claims and is not admitted to be prior art by inclusion in this section.

Waste bins exist which can open based on the detection of a user's hand being waved in front of it. However, such receptacles are inconvenient when the user's hands are full. Additionally, it may be difficult for users to determine the optimal location to wave their hands causing them to waste time waving in various places.

Other waste bins have pedal which can be stepped on in order to cause the lid to open. Yet these pedals must be continuously pressed to keep the lid open restricting the user's movement.

What is needed is a true hands-free operating waste bin.

BRIEF SUMMARY OF THE INVENTION

The below summary is merely representative and non-limiting.

The above problems are overcome, and other advantages may be realized, by the use of the embodiments.

In a first aspect, an embodiment provides a self-opening bin. The bin includes a base unit defining a foot well and a sensor configured to detect whether an object is within the foot well. The bin also has a receptacle and a lid configured to close the receptacle. A lid motor configured to mechanically open the lid is also included in the bin. The lid motor is configured to open the lid in response to detection of an object within the foot well.

In another aspect, an embodiment provides a method for operating a lid opening motor of a bin. The method includes a step of, in response to detection of an object within a foot well of the bin, causing the lid opening motor to open the lid. The method also includes a step of setting the lid opening motor to keep the lid open for at least a first predetermined length of time in response to the object being within the foot well for a first elapsed length of time.

BRIEF DESCRIPTION OF THE SEVERAL VIEWS OF THE DRAWINGS

Other features and advantages of the invention will be apparent from the following description of the preferred embodiments thereof and from the claims, taken in conjunction with the accompanying drawings, in which:

DETAILED DESCRIPTION OF THE INVENTION

This patent application claims priority from U.S. Provisional Patent Application No. 62/727,836, filed Sep. 6, 2018, the disclosure of which is incorporated by reference herein in its entirety.

Various embodiments provide foot activated sensor operated trash bins. Such trash bins can be used for a true hands-free operation. In one, non-limiting embodiment, the trash bin uses a sensor to detect the user's foot and, based upon that detection, cause the lid of the trash bin to open. This keeps the user's hands free to hold and dispose of waste without making additional trips. Additionally, the sensor placement is chosen so as to prevent false signals and accidental lid opening.

Figure 1:
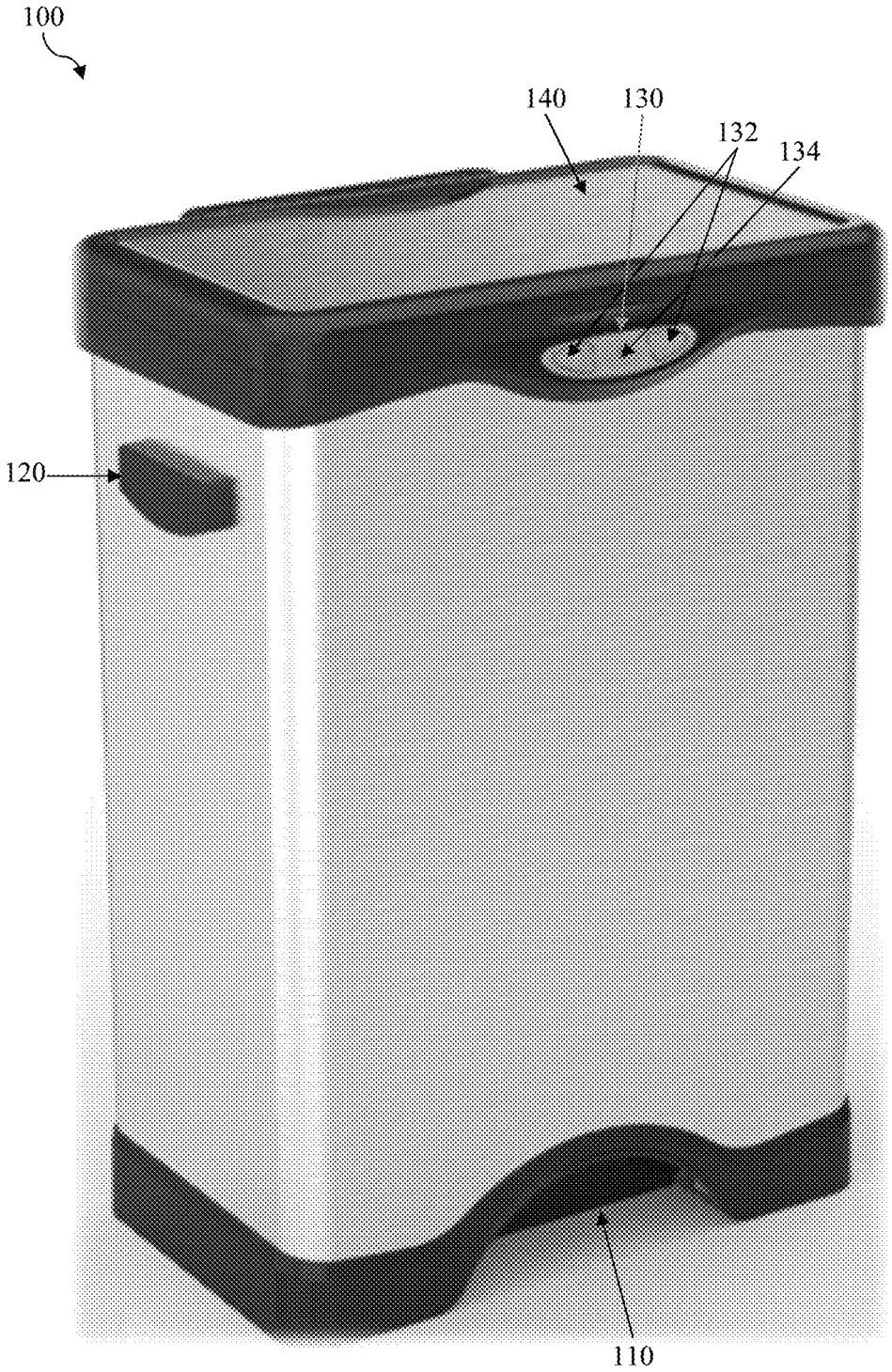
FIG. 1 shows a first waste bin in accordance with an embodiment.

The trash bins may also include various other features, for example:

- Durable Stainless Steel body construction and finger print proof finish
- Extra wide opening for easy and mess-free trash disposal
- Hide-a-bag lid design to hide unsightly bag overlap
- Plastic Inner Liner or Retaining Ring & Pan system
- Non-slip bottom FIG. 1 shows a first waste bin 100 in accordance with an embodiment. As shown, the waste bin 100 includes a foot well 110 which includes a sensor (e.g., an IR sensor 150) which is configured to detect the presence of a user's foot. The waste bin 100 also includes handles 120 and a touch pad 130 for controlling the waste bin. The touch pad 130 includes buttons 132 for opening and closing the lid 140 of the bin 100.

In other embodiments, the touch pad 130 may also include buttons to control other functions. For example, if the waste bin 100 includes a light embedded in the lid 140, the touch pad 130 may include a button to turn on or off that light. The touch pad 130 may also include a motion sensor 134 to detect a user's hand being waved so as to provide additional means for opening the lid 140.

Figure 2:
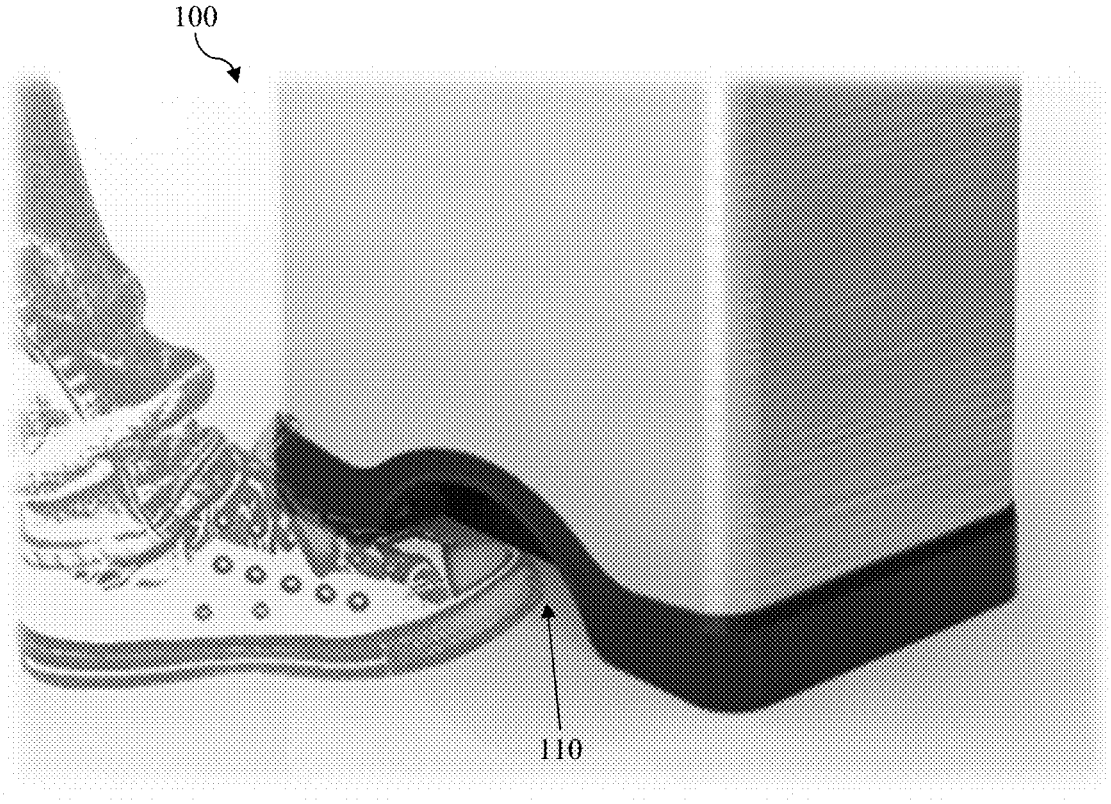
FIG. 2 shows the foot well of the first waste bin.
Figure 3:
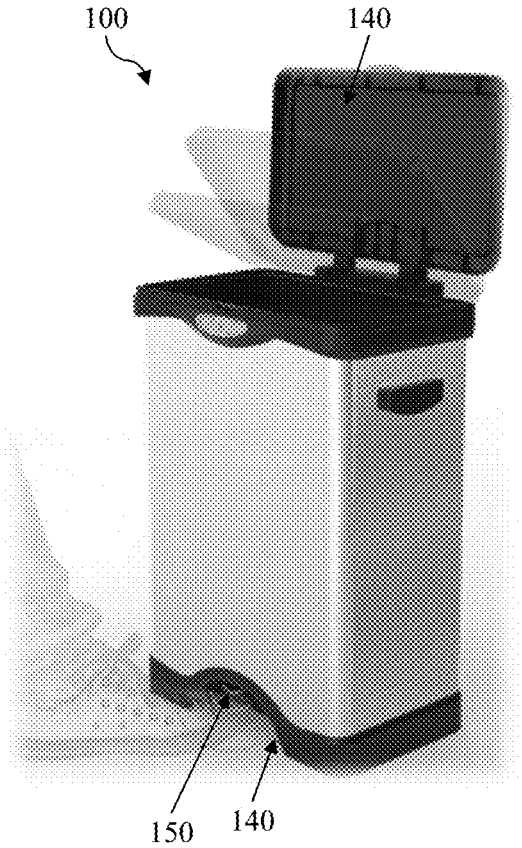
FIG. 3 illustrates the lid of the first waste bin being opened.

FIG. 2 shows the foot well 110 of the first waste bin 100 and FIG. 3 illustrates the lid 140 of the first waste bin 100 being opened. The foot well 110 provides a convenient and easily discernable location for the user to place their foot. Focusing the sensor's range to the foot well 110 (and/or its immediate area) also prevents accidental openings based on false detections.

Inserting an object, such as the toe portion of the foot, into the foot well 110 can trigger the IR sensor 150 inside the foot well 110 which then activates a lid mechanism to open the lid 140. However, the IR sensor command chip can be customized to perform open and close cycles in a variety of optional programs.

In one such program, for example a quick open option, the lid 140 may be configured to open if the foot is left in the foot well for up to four seconds. The lid 140 closes automatically after a certain period of time, such as thirty seconds.

The waste bin 100 may also include other opening options such as an extended lid opening feature. This may be selected by keeping the foot inserted in the foot well 110 for an extended period, e.g., five seconds or more, which causes the lid 140 to remain open for longer, such as five minutes, after which the lid 140 automatically closes. During the extended period, the waste bin 100 may cause the lid 140 to close if the user inserts their foot into the foot well 110 a second time.

The waste bin 100 may also include a fail-safe feature where the lid 140 automatically closes if the sensor 150 continues to detect an object in the foot well 110 for too long, for example, after one minute.

Figure 4:
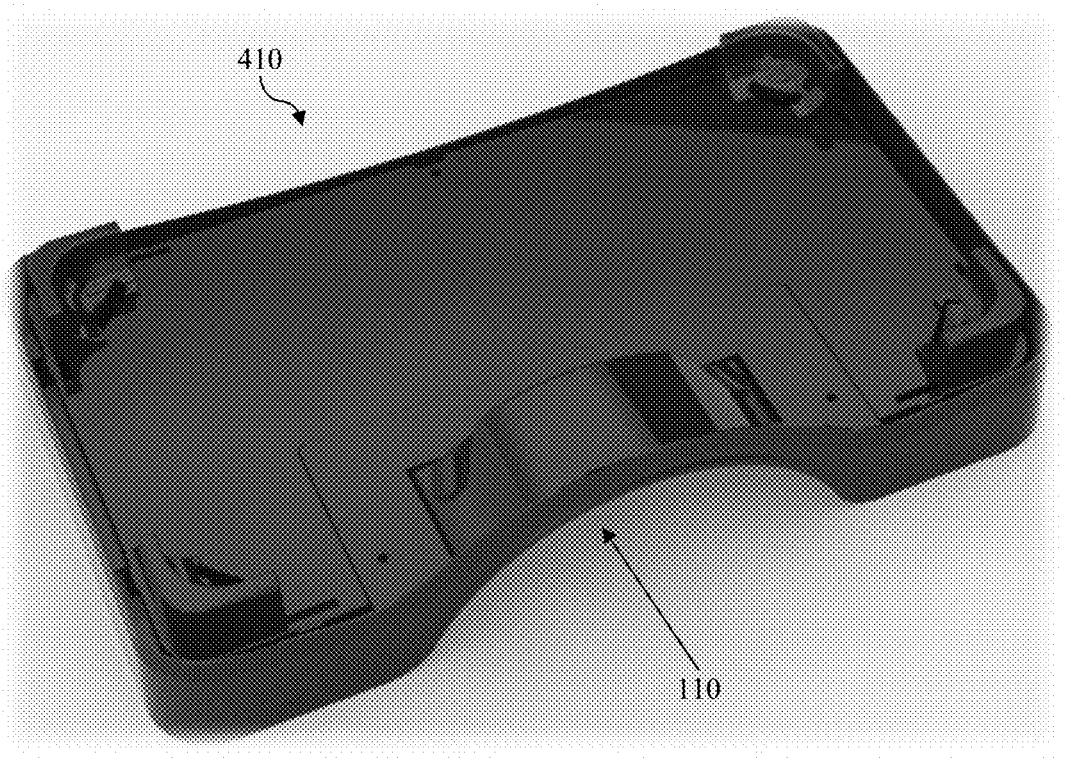
FIG. 4 shows the base of the first waste bin.
Figure 6:
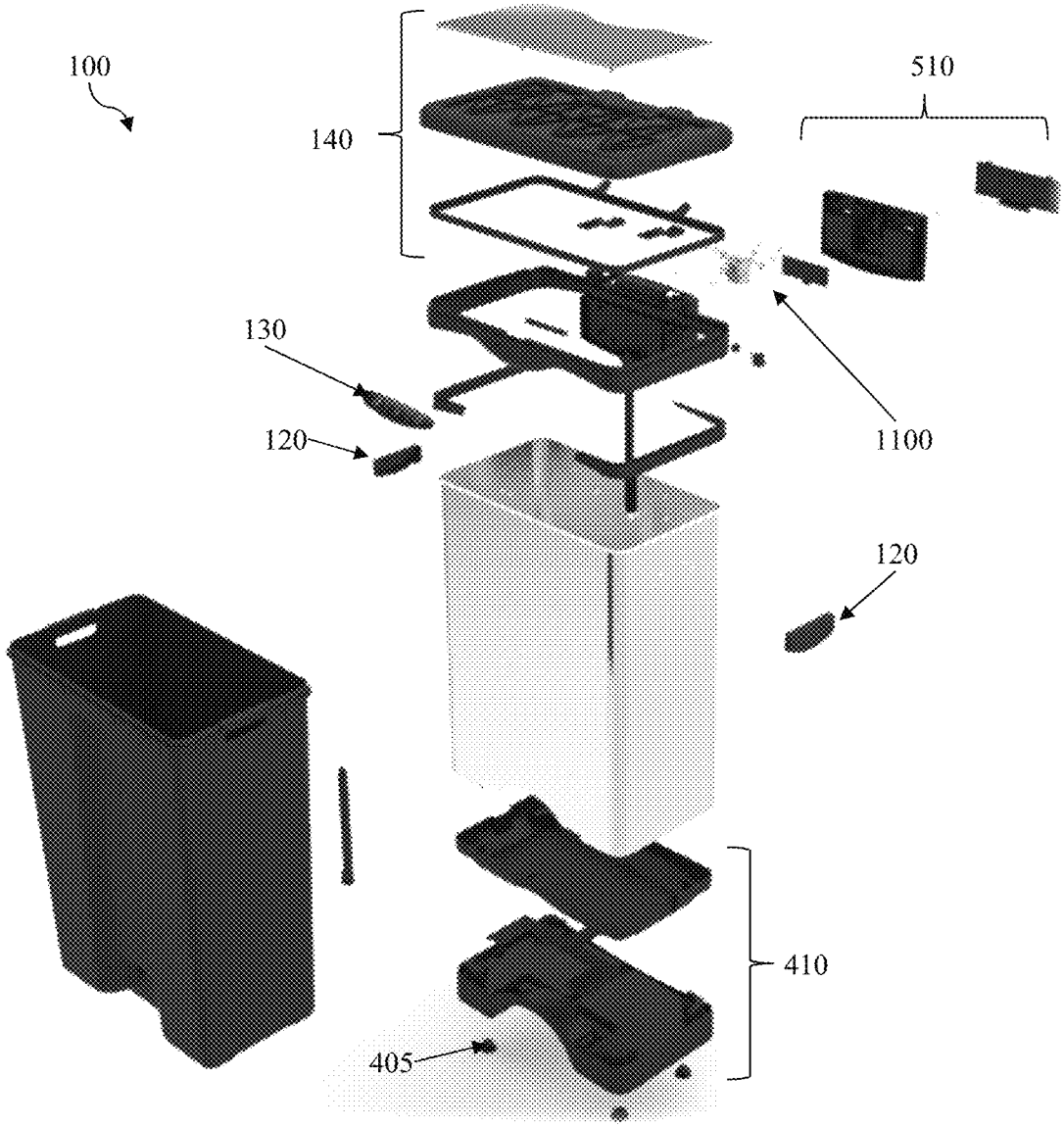
FIG. 6 shows an exploded view of the first waste bin.

FIG. 4 shows the base 410 of the first waste bin 100. The base 410 defines the foot well 110 and provides a protected location for the IR sensor 150. The sensor 150 may be positioned within the foot well 110 so that its detection range is limited to the area within the foot well 110. Alternatively, the sensor's detection range may also include some of the area outside the well 110. As shown in FIG. 6, the base 410 of the first waste bin 100 may also include one or more non-slip feet 405 to help prevent undesired movement of the bin 100.

Figure 5:
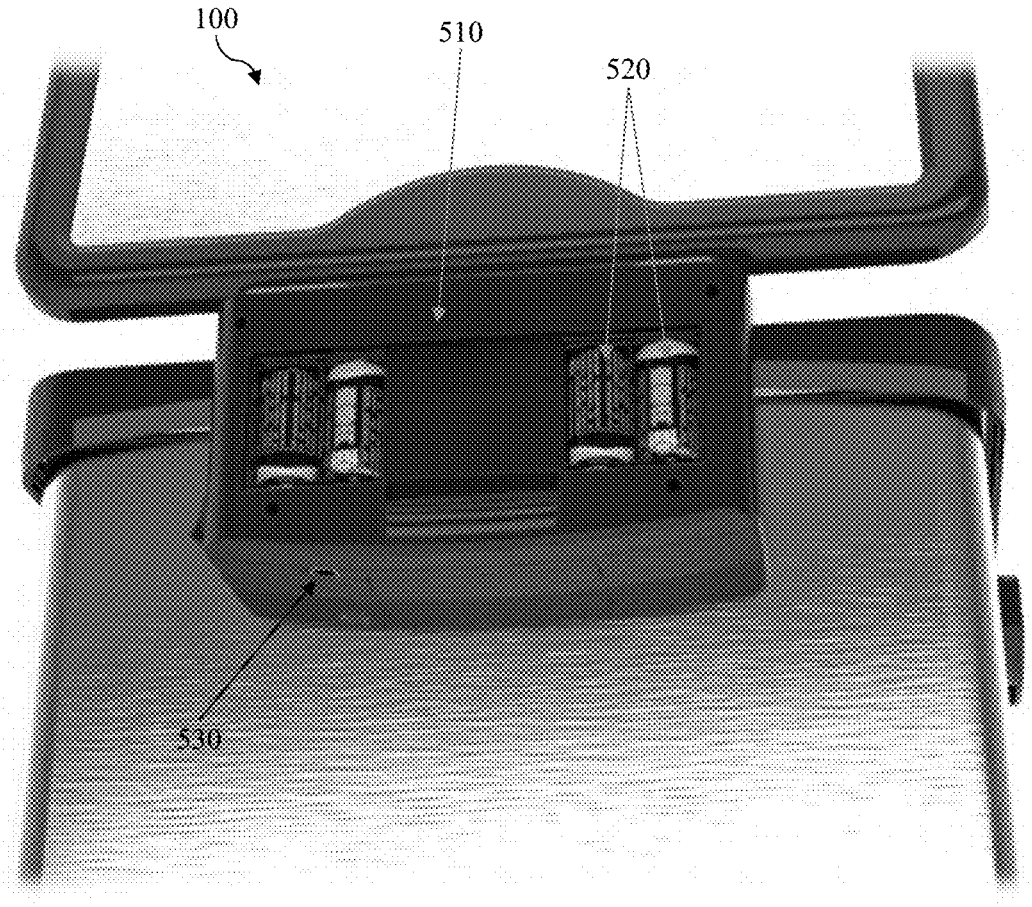
FIG. 5 shows a power pack of the first waste bin.

FIG. 5 shows a power pack 510 of the first waste bin 100. The power pack 510 provides power to the lid opening motor and to the IR sensor 150. In this non-limiting embodiment, the power pack 510 shown includes four batteries 520 and an AC/DC adaptor port 530.

FIG. 6 shows an exploded view of the first waste bin 100.

Figure 7:
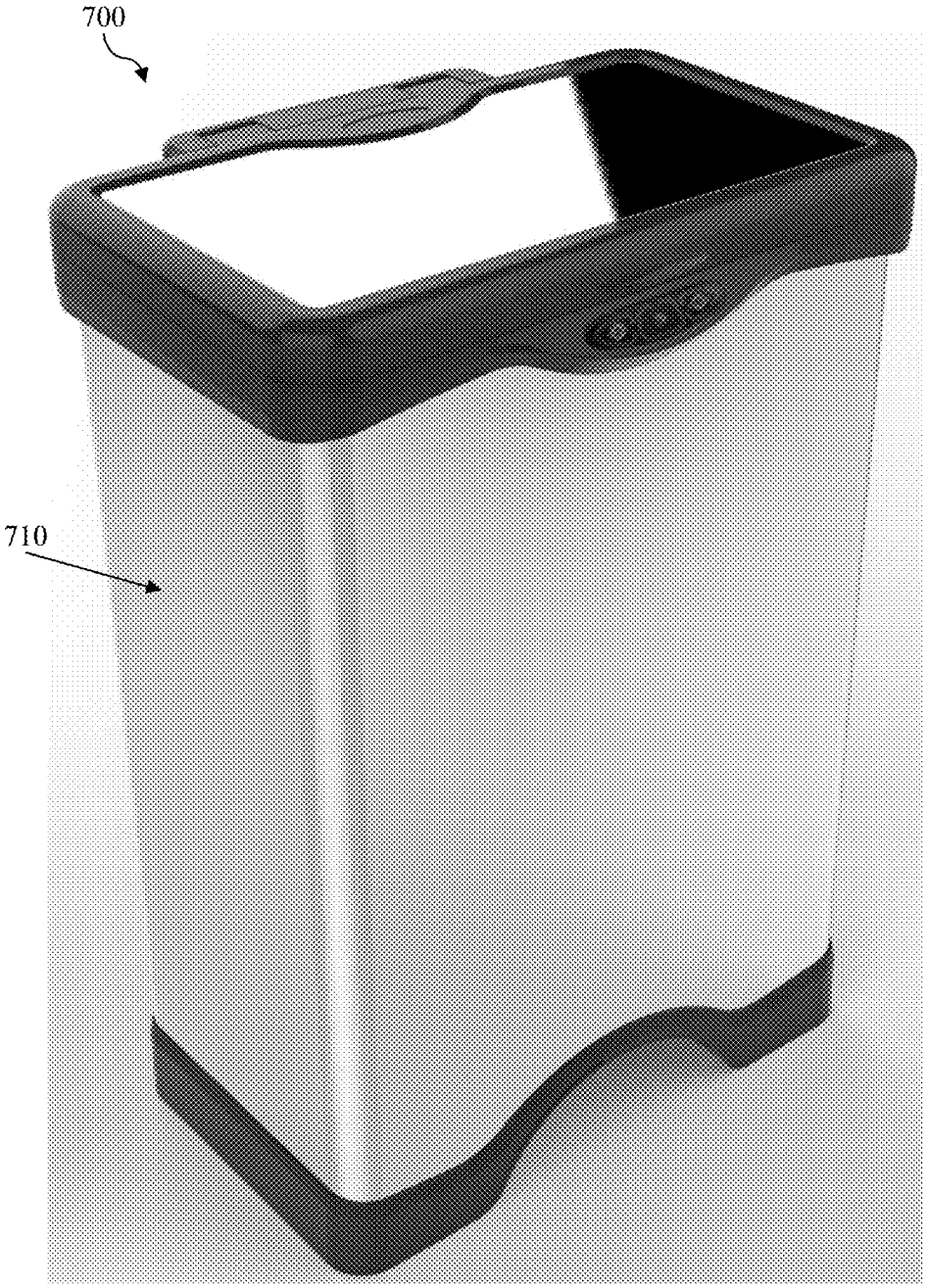
FIG. 7 shows a second waste bin in accordance with another embodiment.
Figure 8:
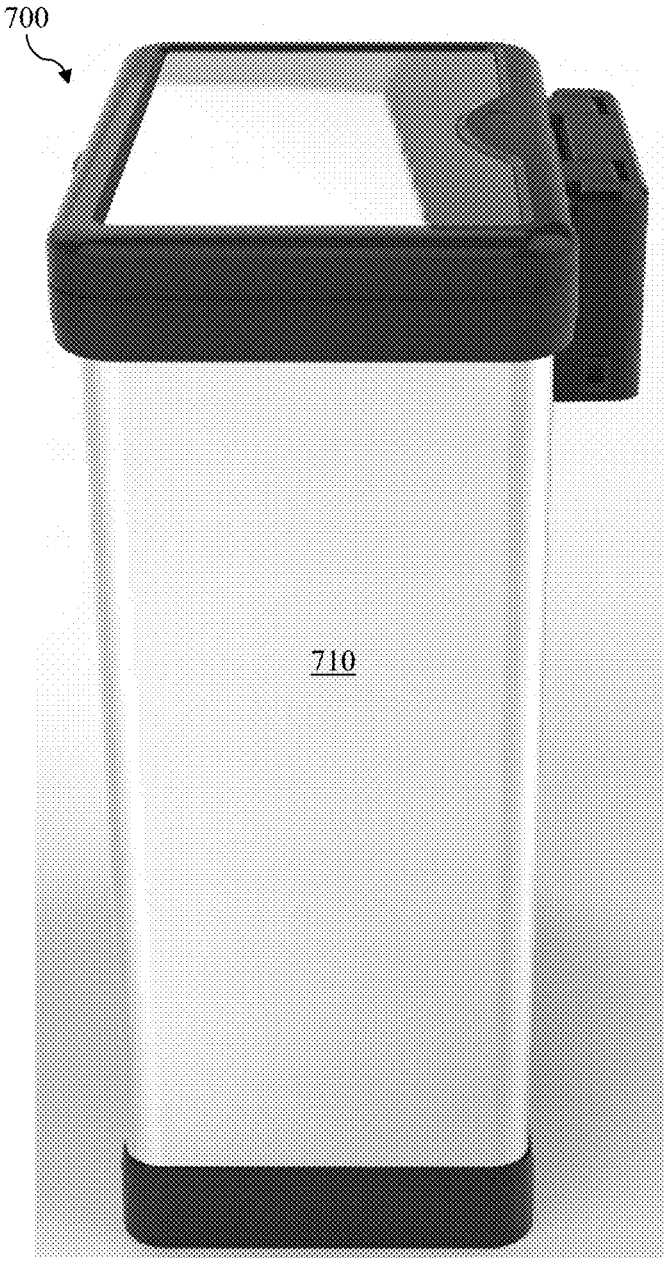
FIG. 8 shows a side of the second waste bin.
Figure 9:
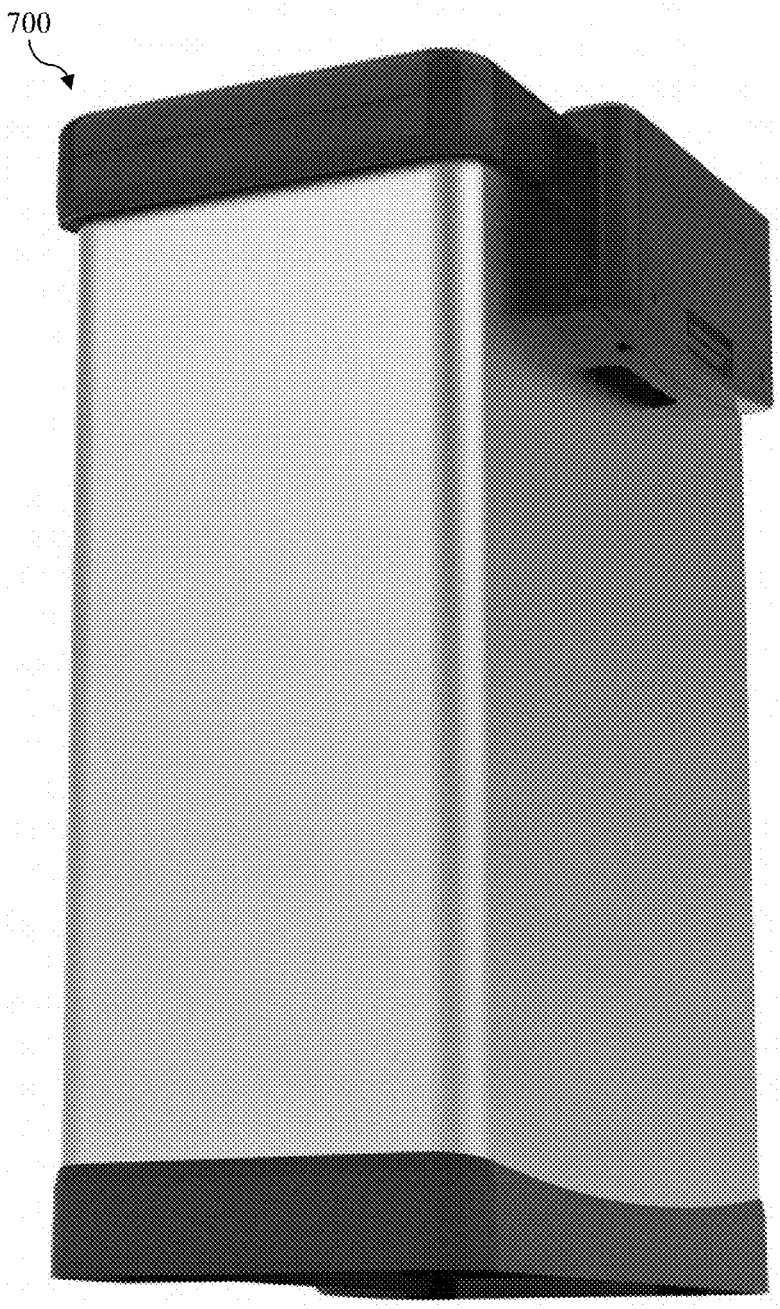
FIG. 9 shows the back and side of the second waste bin.
Figure 10:
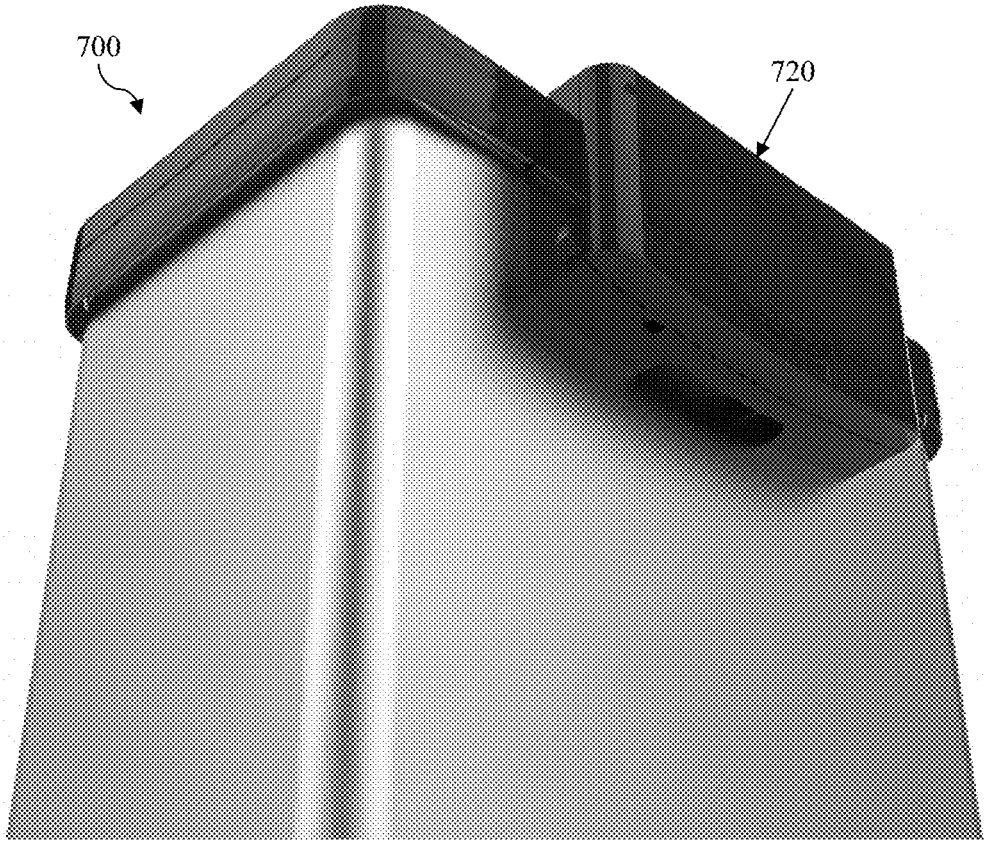
FIG. 10 shows the power pack of the second waste bin.

FIG. 7 shows a second waste bin 700 in accordance with another embodiment. In this embodiment, the waste bin has smooth sides 710 without the handles (such as handles 120) as shown in FIG. 1. FIG. 8 shows a side view of the second waste bin 700, FIG. 9 shows the back and side view of the second waste bin 700 and FIG. 10 shows the power pack 720 of the second waste bin 700.

Figure 11:
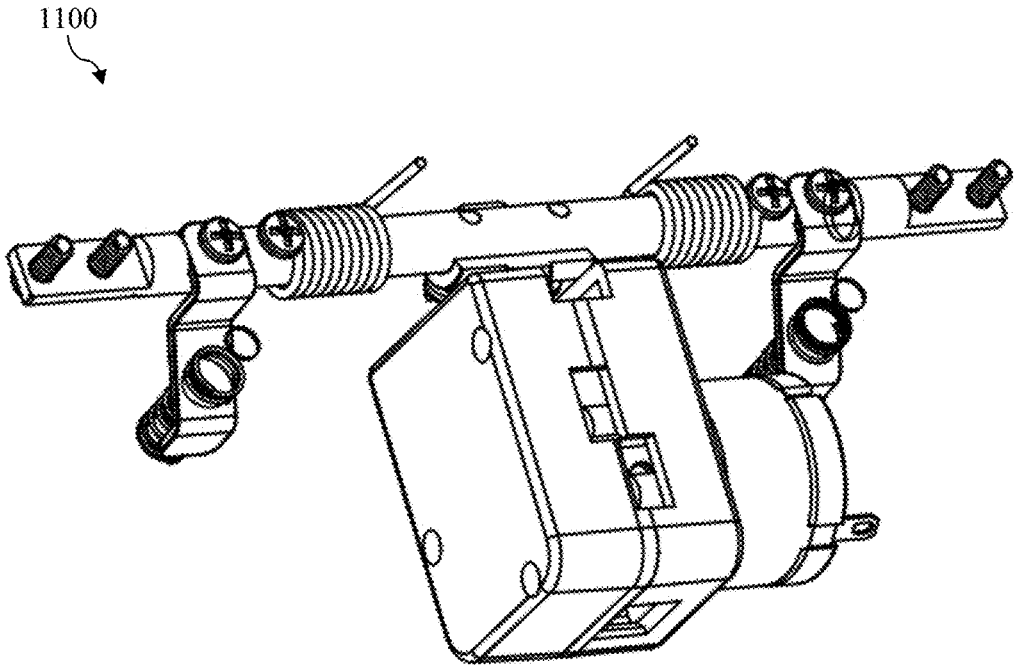
FIG. 11 shows a lid-opening motor in accordance with an embodiment.
Figure 12:
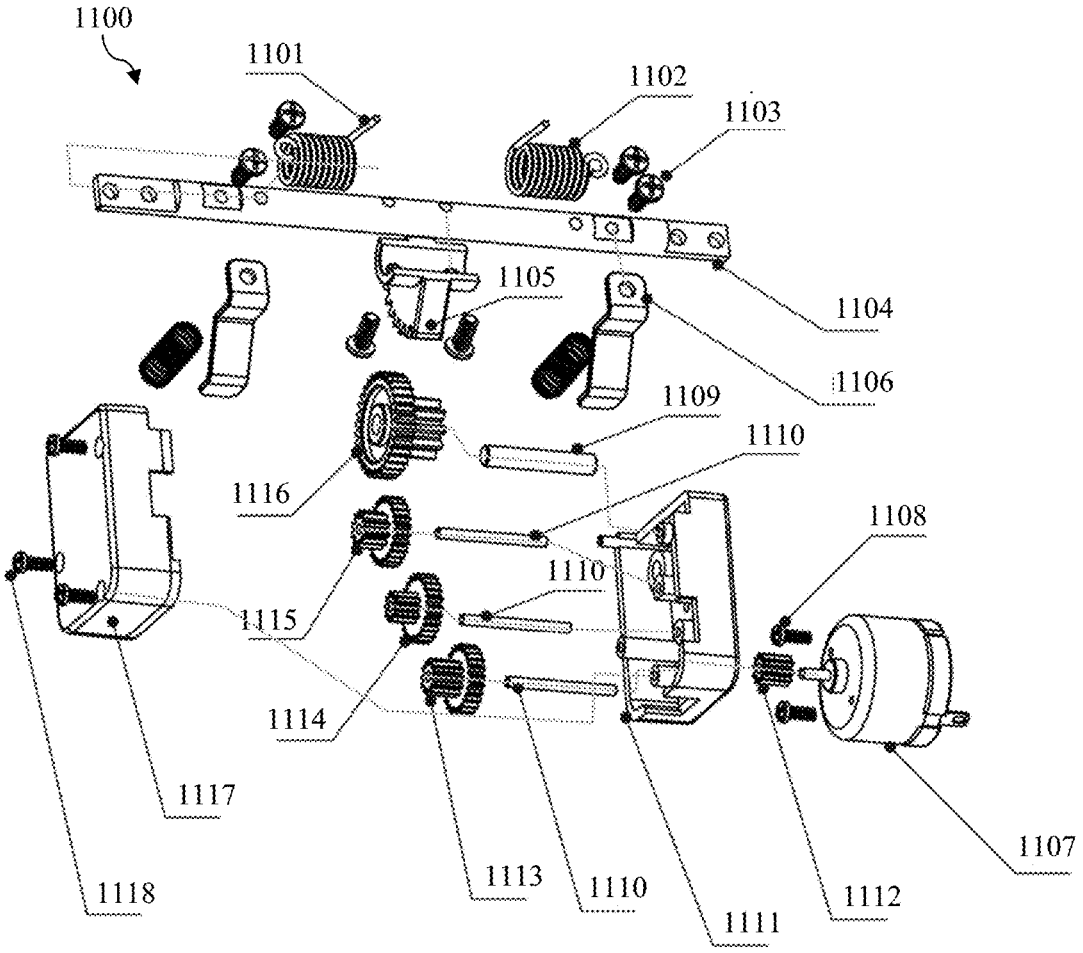
FIG. 12 shows an exploded view of the lid-opening motor.

FIG. 11 shows a lid-opening motor 1100 in accordance with an embodiment. This element, also shown in FIG. 6, can be controlled based on the foot well sensor 150 as described above. FIG. 12 shows an exploded view of the lid-opening motor 1100. The lid-opening motor 1100 includes a right spring 1101 and a left spring 1102 which are fastened by screws 1103 to the bar 1104. A gear 1105 and lid fasteners 1106 are also connected to the bar 1104. A motor 1107 is used to rotate the bar 1104 via the gears 1112, 1113, 1114, 1115, 1116 and shafts 1109, 1110 which are enclosed between covers 1111 and 1117. Screws 1108 and 1118 secure the motor and covers.

In the embodiments above, the foot well sensor 150 is an IR sensor. In alternative embodiments, other types of sensors may be used, for example, a laser tripwire, etc.

The receptacles as shown are trash bins, such as may be found in the home and, in particular, in a kitchen setting. However, such receptacles could also be adapted for use in professional settings such as offices, medical facilities, etc.

Given the likely use of the receptacle for receiving refuse, it may be preferred that the bin be resilient, pliant, dirt and stain resistant, and easily cleaned. In one embodiment, portions of the bin are formed of stainless-steel or formed of plastic such as polyurethane. Portions of the bin may be tinted or pigmented to a variety of colors or combinations of colors. A pattern may be formed in or pressed onto the outer surface of the bin, and the outer surface may have a flat (e.g., light-absorbent) surface, an enamel (e.g., light-reflecting) surface, or a surface that is some combination of both.

Additional components and features may be added to enhance the functionality or appearance of the receptacle, such as air holes, air-fresheners, a non-slip base, foot well nightlight, etc.

In further embodiments, the waste bins may have various sizes and/or shapes. As an example, other, non-limiting embodiments may be either oval or round shaped. Other shapes may also be used, such as triangular, wedge or corner-shaped, and square or rectangular shaped.

Features or structures may also be added to some embodiments. These may include wheels, handles, weights (which may be embedded in the base), lights, various devices (e.g., a paper shredder) and/or structures to operate with such devices, etc.

One, non-limiting embodiment provides a self-opening bin. The bin includes a base unit defining a foot well and a sensor configured to detect whether an object is within the foot well. The bin also has a receptacle and a lid configured to close the receptacle. A lid motor configured to mechanically open the lid is also included in the bin. The lid motor is configured to open the lid in response to detection of an object within the foot well.

In a further embodiment of the bin above, the sensor is an infrared sensor or a laser tripwire sensor.

In another embodiment of any one of the bins above, the receptacle includes an exterior, stainless steel shell.

In a further embodiment of any one of the bins above, the receptacle includes an interior, plastic shell.

In another embodiment of any one of the bins above, the base unit further includes at least one non-slip foot.

In a further embodiment of any one of the bins above, the lid includes a lid light. The lid light may be configured to turn on when the lid is opened or to turn on after the lid has been opened for at least a predetermined length of time.

In another embodiment of any one of the bins above, the base unit also includes a nightlight configured to illuminate the foot well.

In a further embodiment of any one of the bins above, the bin also includes a touch pad having at least one button configured to open the lid.

In another embodiment of any one of the bins above, the base unit also includes a touch pad having a motion sensor. The lid motor being further configured to open the lid, when the lid is closed, in response to detection of an object moving by the motion sensor. The lid motor may also be configured to close the lid, when the lid is open, in response to detection of an object moving by the motion sensor.

In a further embodiment of any one of the bins above, the bin also includes a command chip configured to control the lid motor to open the lid in response to detection of an object within the foot well. The command chip may be configured to cause the lid motor to keep the lid open while the object is within the foot well. The command chip may be configured to cause the lid motor to keep the lid open for at least a first predetermined length of time if the object is within the foot well for a first elapsed length of time. The command chip may cause the lid motor to keep the lid open for at least a second predetermined length of time if the object is within the foot well for a second elapsed length of time. The second predetermined length of time being greater than the first predetermined length of time and the second elapsed length of time being greater than the first elapsed length of time. The command chip may be configured to cause the lid motor to close the lid in response to subsequent detection of an object within the foot well during the first predetermined length of time. The command chip may cause the lid motor to close the lid if the object is within the foot well for a second elapsed length of time, the second elapsed length of time being greater than the first elapsed length of time.

Another, non-limiting embodiment provides a method for operating a lid opening motor of a bin. The method includes a step of, in response to detection of an object within a foot well of the bin, causing the lid opening motor to open the lid. The method also includes a step of setting the lid opening motor to keep the lid open for at least a first predetermined length of time in response to the object being within the foot well for a first elapsed length of time.

In a further embodiment of the method above, the method includes a step of causing the lid motor to close the lid in response to the object being within the foot well for a second elapsed length of time. The second elapsed length of time being greater than the first elapsed length of time.

The foregoing description has been directed to particular embodiments. However, other variations and modifications may be made to the described embodiments, with the attainment of some or all of their advantages. Modifications to the above-described systems and methods may be made without departing from the concepts disclosed herein. Accordingly, the invention should not be viewed as limited by the disclosed embodiments. Furthermore, various features of the described embodiments may be used without the corresponding use of other features. Thus, this description should be read as merely illustrative of various principles, and not in limitation of the invention.

What is claimed is:

1. A bin comprising:

a base unit defining a foot well, wherein the base unit further comprises a nightlight configured to illuminate the foot well;

a sensor configured to detect whether an object is within the foot well;

a receptacle;

a lid configured to move between and open and a closed position, said open lid position providing access to said receptacle and said closed lid position serving to close access to the receptacle;

a lid motor configured to mechanically open and close the lid, wherein the lid motor is configured to open the lid in response to detection of an object within the foot well; and a command chip, responsive to the sensor and configured to control the lid motor to open the lid in response to detection of an object within the foot well by the sensor, wherein the command chip is configured to cause the lid motor to keep the lid open for at least a first predetermined length of time if the object is detected within the foot well for a first elapsed length of time, and wherein the command chip is further configured to cause the lid motor to keep the lip open for at least a second predetermined length of time if the object is detected within the foot well for a second elapsed length of time, the second predetermined length of time that the command chip controls the lid motor to keep the lid open being greater than the first predeterminded length of time that the command chip controls the lid motor to keep the lid open, and wherein the second elapsed length of time that the object is detected within the foot well being greater than the first elapsed length of time that the object is detected with the foot well.

2. The bin as in claim 1, wherein the sensor is one of: an infrared sensor and a laser tripwire sensor.

3. The bin as in claim 1, wherein the receptacle comprises an exterior, stainless steel shell.

4. The bin as in claim 1, wherein the receptacle comprises an interior, plastic shell.

5. The bin as in claim 1, wherein the base unit further comprises at least one non-slip foot.

6. The bin as in claim 1, wherein the lid comprises a lid light.

7. The bin as in claim 6, wherein the lid light is configured to turn on when the lid is opened.

8. The bin as in claim 6, wherein the lid light is configured to turn on after the lid has been opened for at least a predetermined length of time.

9. The bin as in claim 1, further comprising a touch pad, the touch pad having at least one button configured to open the lid.

10. The bin as in claim 1, further comprising a touch pad having a motion sensor, the lid motor being further configured to open the lid, when the lid is closed, in response to detection of an object moving by the motion sensor.

11. The bin as in claim 10, wherein the lid motor is further configured to close the lid, when the lid is open, in response to detection of an object moving by the motion sensor.

12. The bin as in claim 1, wherein the command chip is configured to cause the lid motor to keep the lid open while the object is within the foot well.

13. The bin as in claim 1, wherein the command chip is further configured to cause the lid motor to close the lid if the object is within the foot well for a second elapsed length of time, the second elapsed length of time being greater than the first elapsed length of time.

* * * * *